US007275993B2

(12) United States Patent
Hosaka et al.

(10) Patent No.: US 7,275,993 B2
(45) Date of Patent: Oct. 2, 2007

(54) GAME MACHINE AND MONITOR SYSTEM

(75) Inventors: Toshiyuki Hosaka, Matsumoto (JP); Masafumi Sakaguchi, Suwa (JP)

(73) Assignee: Seiko Epson Corporation (JP)

( * ) Notice: Subject to any disclaimer, the term of this patent is extended or adjusted under 35 U.S.C. 154(b) by 766 days.

(21) Appl. No.: 10/637,756

(22) Filed: Aug. 8, 2003

(65) Prior Publication Data

US 2004/0105003 A1 Jun. 3, 2004

(30) Foreign Application Priority Data

Aug. 9, 2002 (JP) ..... 2002-233883
Jun. 11, 2003 (JP) ..... 2003-166841

(51) Int. Cl.
*A63F 9/24* (2006.01)

(52) U.S. Cl. ..... 463/34

(58) Field of Classification Search ..... None
See application file for complete search history.

(56) References Cited

U.S. PATENT DOCUMENTS 5,190,286 A * 3/1993 Watanabe et al. ..... 463/5
5,941,774 A * 8/1999 Takemoto et al. ..... 463/31

* cited by examiner

*Primary Examiner*—Mark Sager
(74) *Attorney, Agent, or Firm*—Harness, Dickey & Pierce, P.L.C.

(57) ABSTRACT

A camera picks-up an image external of a game machine and outputs image pick-up data Dv. A display control part controls the camera to pick-up an image and outputs the image pick-up data DV to an external device. In this case, a display device for displaying an image for a game is provided. When prescribed conditions are satisfied, the display control part controls the display device to display an image based on image data Dp extracted from the image pick-up data Dv as a part of the image for a game.

7 Claims, 15 Drawing Sheets

GAME MACHINE AND MONITOR SYSTEM

BACKGROUND OF THE INVENTION

1. Technical Field

The present invention relates to a game machine that is installed in a game place and a monitor system capable of picking-up the image of the game place and displaying the picked-up image.

2. Related Art

Generally, a monitor system (as one example, a camera monitor system disclosed in JP-A-3-93379) is disposed in a pachinko parlor for the purpose of detecting a fire generated in the parlor or an illegal behavior by a player. The monitor system of this kind comprises a plurality of monitor cameras disposed in the vicinity of such as a ceiling of the parlor to pick-up the images of the parlor. The monitor system further includes a controller disposed in a management room for controlling a plurality of images (images in the parlor) based on video signals respectively outputted by the monitor cameras to be displayed on a single monitor capable of dividing and displaying the plural images on one screen or to be displayed on a plurality of monitors capable of individually displaying the respective images. In this case, the controller controls the images based on the video signals respectively outputted by the monitor cameras to be switched and displayed on the single monitor or the plural monitors in accordance with a prescribed sequence or a sequence set by an operator. At this time, when the operator detects any abnormality in the switched and displayed images, the operator selects and operates the monitor camera which picks-up an image of a place corresponding to the image or the monitor camera capable of more clearly picking up the image of the place. Thus, the fire in the parlor or a wrong behavior by a player can be detected in the management room.

However, such kind of conventional monitor system has following problems. Such a conventional monitor system employs monitor cameras disposed in the vicinity of the ceiling to display images for monitoring the parlor on the monitors. On the other hand, a person who conducts an illegal behavior allows, for instance, the person himself (or herself) or a pachinko machine board as a target of the illegal behavior to be surrounded and hidden by an accomplice to interrupt the image picking-up operation of the illegal behavior by the monitor cameras. At this time, when only the images displayed on the monitors are monitored by the controller, the image of the display part of the game machine for which the illegal behavior is conducted is not picked-up. Accordingly, it is difficult to discriminate whether the accomplice who surrounds the player intentionally blocks an image pick-up operation or they simply watch a game. Therefore, the conventional monitor system has a problem that a certain image of the illegal behavior by the person who conducts the illegal behavior is hardly picked-up and detected.

In this case, a monitor method may be proposed that more monitor cameras are disposed in the pachinko parlor to switch and control respectively the monitor cameras so that the images of players or game machines are picked-up from all angles. However, in this monitor method, many monitor cameras are disposed in the parlor, which causes ordinary players who have no intention to perform the illegal behavior to have discomfort. Further, even when the number of monitor cameras installed in the parlor is increased, many people can surround the player or the game machine to interrupt the image picking-up operation. Thus, the certain image of the illegal behavior is still hardly picked-up and detected.

The present invention is proposed by taking the above-described problems into consideration and it is a main object of the present invention to provide a game machine and a monitor system capable of reliably picking-up an image of an illegal behavior. Further, it is another object of the present invention to provide a game machine and a monitor system capable of monitoring a game place without giving an uneasy feeling to players.

SUMMARY

In order to achieve the above-described objects, a game machine according to the present invention comprises an image pick-up device for picking-up the image of the game machine from the front surface side to the external part of the game machine and outputting image pick-up data; and a control part for controlling the image pick-up operation by the image pick-up device and outputting the image pick-up data to an external device.

Further, in the game machine according to the present invention, the game machine includes an image display device for a game for displaying an image for a game. The control part displays an image based on image data extracted from the image pick-up data on the image display device for a game as a part of the image for a game when prescribed conditions are satisfied.

In the game machine according to the present invention, the image display device for a game includes a projection mechanism for projecting and displaying the image for a game on a display part (game board surface) of the game machine from a rear surface side thereof. The image pick-up device is disposed in the rear surface side of the display part to pick-up the image of the external part of the game machine through the display part.

In the game machine according to the present invention, an image pick-up data storing part for storing the image pick-up data is provided.

Further, a monitor system according to the present invention comprises: a plurality of game machines defined in any of the above; a monitoring display device capable of displaying an image, and a controller for controlling an image based on each image pick-up data outputted by each game machine to be displayed on the monitoring display device.

Further, in the monitor system according to the present invention, the controller controls the images respectively based on the image pick-up data outputted by the game machines respectively to be switched and displayed on the monitoring display device in a prescribed sequence.

In the monitoring system according to the present invention, the controller has an operating part for selecting an arbitrary game machine from the game machines. The controller controls the image based on the image pick-up data outputted by the game machine selected by operating the operating part to be displayed on the monitoring display device.

In the monitoring system according to the present invention, the system includes an image pick-up data storage device connected to the controller to store the image pick-up data respectively outputted from the game machines.

According to the above-described game machine and the monitor system, the control part outputs the image pick-up data picked-up by the image pick-up device to the external device, and, for instance, the external device allows the image picked-up by each game machine to be displayed on the monitoring display device. Thus, the image of an illegal action conducted in front of the game machine can be reliably picked- up and displayed on the monitoring display device. The above-described monitor system is different from the monitor system in which the image is picked up by the monitor cameras disposed in the vicinity of the ceiling in the game place. In this case, a structure that the image pick-up device is disposed in the front of the game machine to pick-up an image is used. Thus, a player can clearly recognize the existence of the image pick-up device (a fact that the image of a player himself (or herself) is picked up). Accordingly, an illegal action by the player can be prevented. Further, when the prescribed conditions are satisfied, the control part displays the image based on the image data extracted from the image pick-up data on the image display device for a game as a part of the image for a game. Thus, the image for a game can be displayed in more various patterns as compared with a display method for displaying an image for a game only by using previously prepared image data. Consequently, the weariness of a player can be prevented from arising.

Further, the image display device for a game includes the projection mechanism for projecting and displaying the image for a game on the display part (game board surface) of the game machine from the rear surface side thereof. The image pick-up device picks-up the image of the external side of the game machine through the display part from the rear surface side of the display part. Thus, the player does not recognize the existence of the image pick-up device and the image of the front surface of the game machine can be picked-up. Accordingly, even when the image pick-up device is disposed for each game machine, the game place can be monitored without giving discomfort to the players. Further, since the front surface side (such as faces of players) of the game machine can be brightly illuminated by projection light for projecting and displaying the image for a game, a clear and vivid image can be picked-up. Further, the game machine according to the present invention includes the image pick-up data storing part for storing the image pick-up data. Accordingly, for instance, when the illegal action is conducted, the image pick-up data obtained by picking-up the image of the action can be used as evidence. When, for example the face of the player is used as a part of the image for a game, image data of a picture pattern on which the face of the player is drawn is extracted from the image pick-up data stored in the image pick-up data storing part and the extracted data can be used.

Further, in the monitor system according to the present invention, the controller switches and displays the images respectively picked-up by the game machines on the monitoring display device in a prescribed sequence. Thus, a small number of monitors can display the images respectively picked-up by the game machines. Therefore, the game place can be entirely monitored at low cost. Further, the controller displays the image picked-up by the game machine selected by operating the operating part on the monitoring display device. Thus, for instance, the game machine that picks-up the image of a suspicious person is selected so that the behavior of the suspicious person can be continuously monitored. As a result, the illegal action is prevented from being performed. Further, the image pick-up data storage device for storing each image pick-up data outputted by each game machine is provided, and accordingly, for instance, when the illegal action is conducted, the image pick-up data obtained by picking-up the action can be used as evidence.

DETAILED DESCRIPTION

Now, referring to the accompanying drawings, preferred embodiments of a game machine and a monitor system according to the present invention will be described below.

Figure 1:
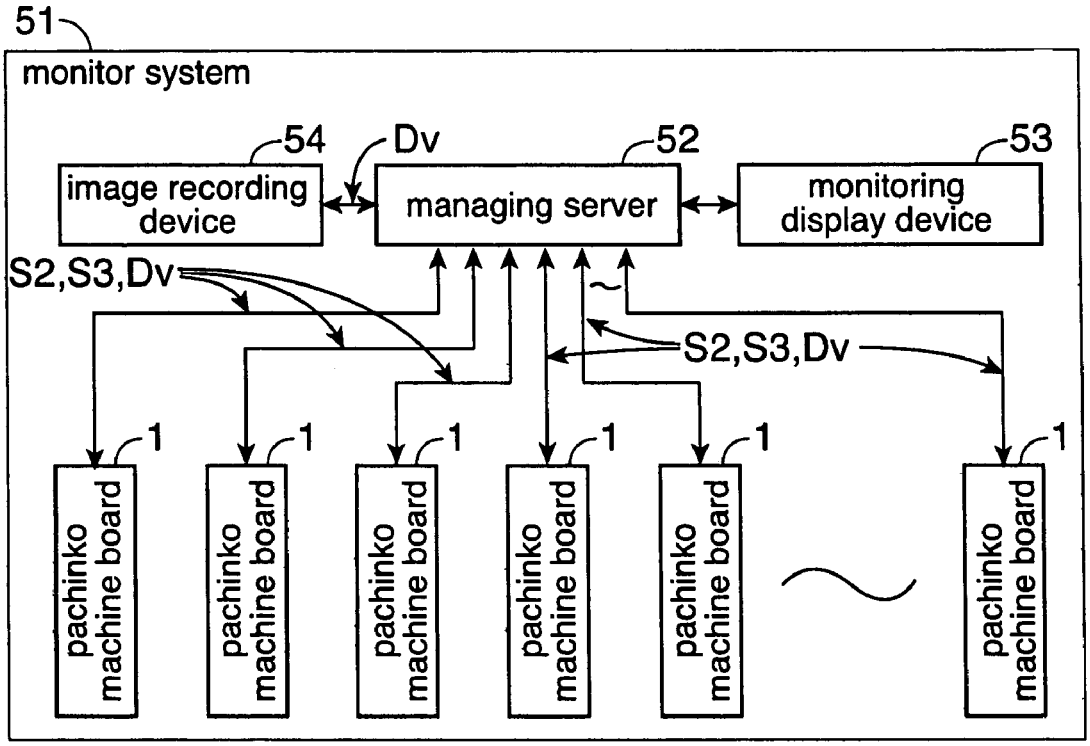
FIG. 1 is a block diagram showing the structure of a monitor system.

The structure of a monitor system 51 is firstly described by referring to FIG. 1. The monitor system 51 comprises a plurality of pachinko machine boards 1, 1 . . . provided in a pachinko parlor (game place), a managing server 52 installed in a managing room and a monitoring display device 53 and an image recording device 54 connected to the managing server 52. The pachinko machine board 1 corresponds to the game machine in the present invention. The image of the pachinko machine board 1 is picked-up, as described below, from its front surface side to an outer part (that is, the image of a surface side opposed to a front surface panel is picked-up) to output image pick-up data Dv to the managing server 52. The managing server 52 corresponds to the external device and the controller in the present invention. For instance, one managing server 52 is installed for each pachinko parlor and connected to the pachinko machine boards 1, 1 . . . respectively in the pachinko parlor through a LAN (Local Area Network). In this case, the managing server 52 may be connected respectively to the pachinko machine boards 1, 1 . . . either by a wired connection method or a wireless connection method. Further, the managing server 52 displays images in the parlor on the monitoring display device 53 based on image pick-up data Dv, Dv . . . respectively outputted from the pachinko machine boards 1, 1 . . . .

In this case, the managing server 52 switches and displays, under an ordinary state, the images based on the image pick-up data Dv, Dv . . . respectively outputted by the pachinko machine boards 1, 1 . . . on the monitoring display device 53 in a prescribed sequence. When an operator selects and operates an arbitrary pachinko machine board 1 from among the pachinko machine boards 1, 1 . . . , the image based on the image pick-up data Dv outputted by the pachinko machine board 1 is preferentially displayed on the monitoring display device 53. The monitoring display device 53 includes a plurality of monitors (for example, six monitors) capable of switching and displaying images in the parlor respectively picked-up by the pachinko machine boards 1 under the control of the managing server 52. The image recording device 54 corresponds to the image pick-up data storage device in the present invention to record the image pick-up data Dv respectively outputted by the pachinko machine boards 1 under the control of the managing server 52. In the embodiment of the present invention, as one example, six video recorders (the same number as that of the monitors in the monitoring display device 53) for individually recording images respectively displayed on the monitors of the monitoring display device 53 form the image recording device 54. In this case, the image recording device 54 may be either a type that the image pick-up data Dv is directly recorded in the form of digital data or a type that the image pick-up data Dv is converted to an analog signal and then the analog signal is recorded.

Figure 2:
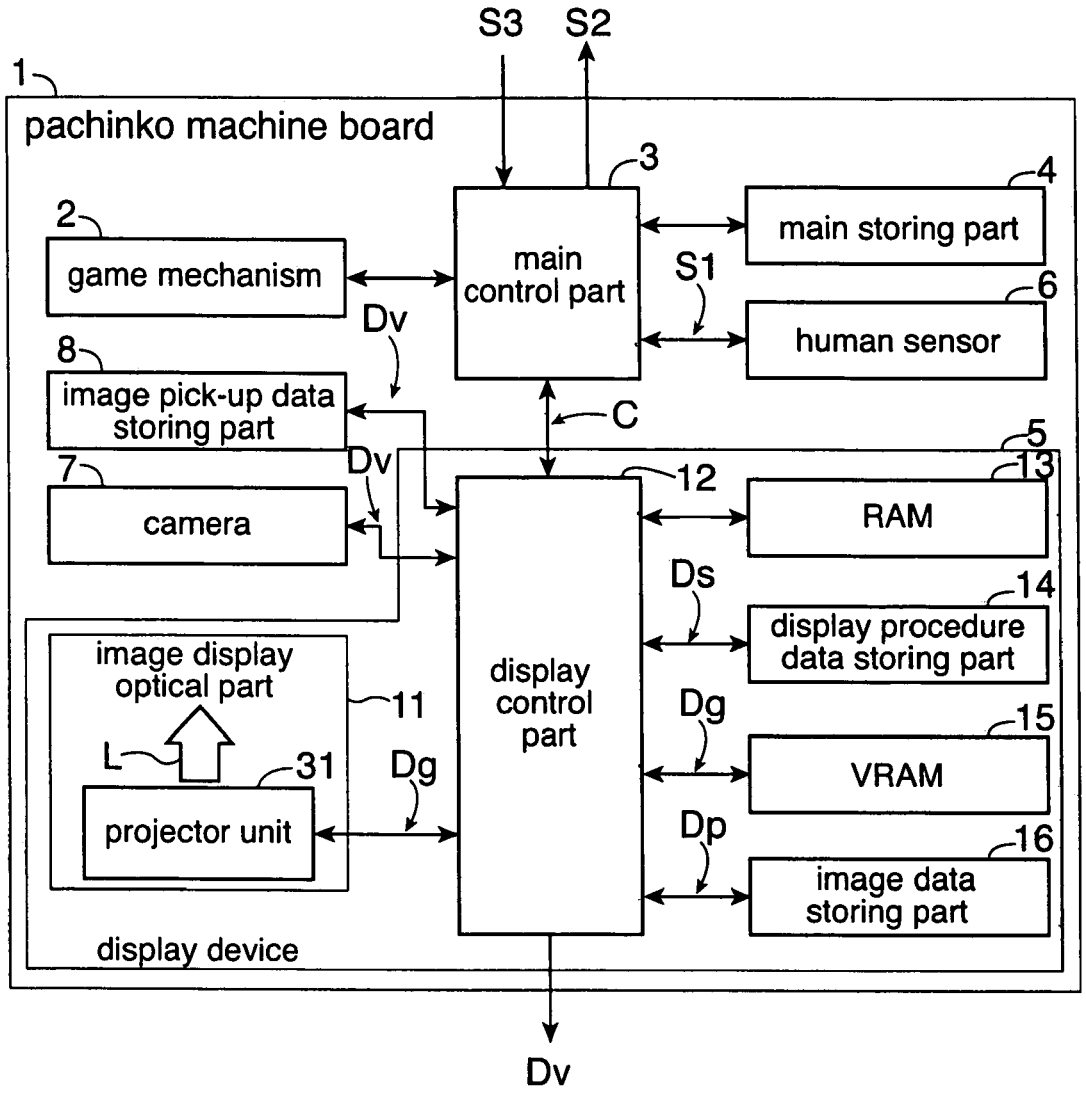
FIG. 2 is a block diagram showing the structure of a pachinko machine board.
Figure 3:
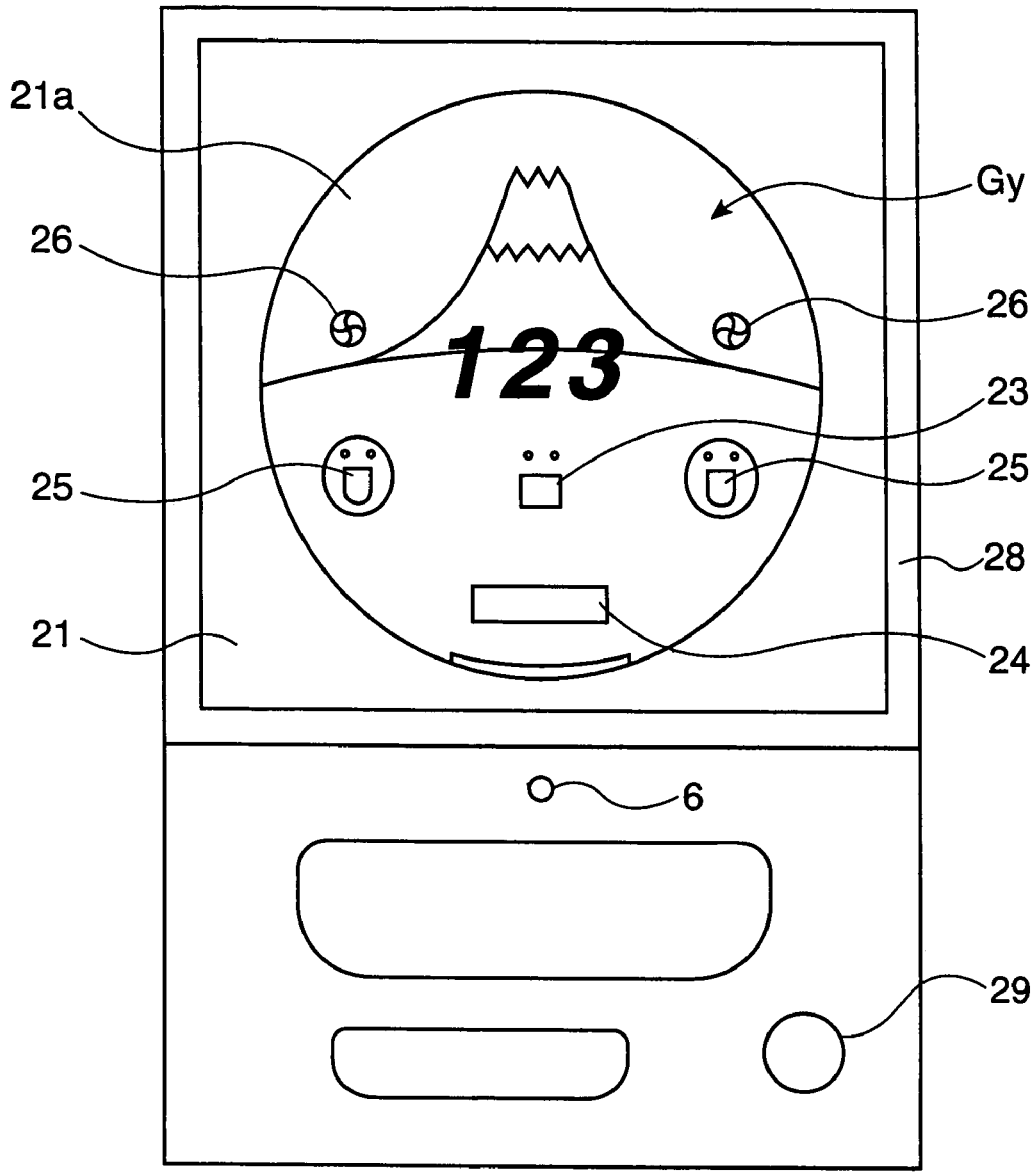
FIG. 3 is a front view showing a schematic structure of the pachinko machine board.

Now, the structure of the pachinko machine board 1 is described by referring to the drawings. The pachinko machine board 1 is, as one example, a pachinko machine board of a "seven machine" type that a "big hit" is generated by a lottery. As shown in FIG. 3, an image for a game Gy (in this case, the ground, Mt. Fuji and FIGS. "123") can be projected and displayed on a game board 21 by a rear injection system. The pachinko machine board 1 includes, as shown in FIG. 2, a game mechanism 2, a main control part 3, a main storing part 4, a display device 5, a user sensor 6, a camera 7 and an image pick-up data storing part 8.

Figure 4:
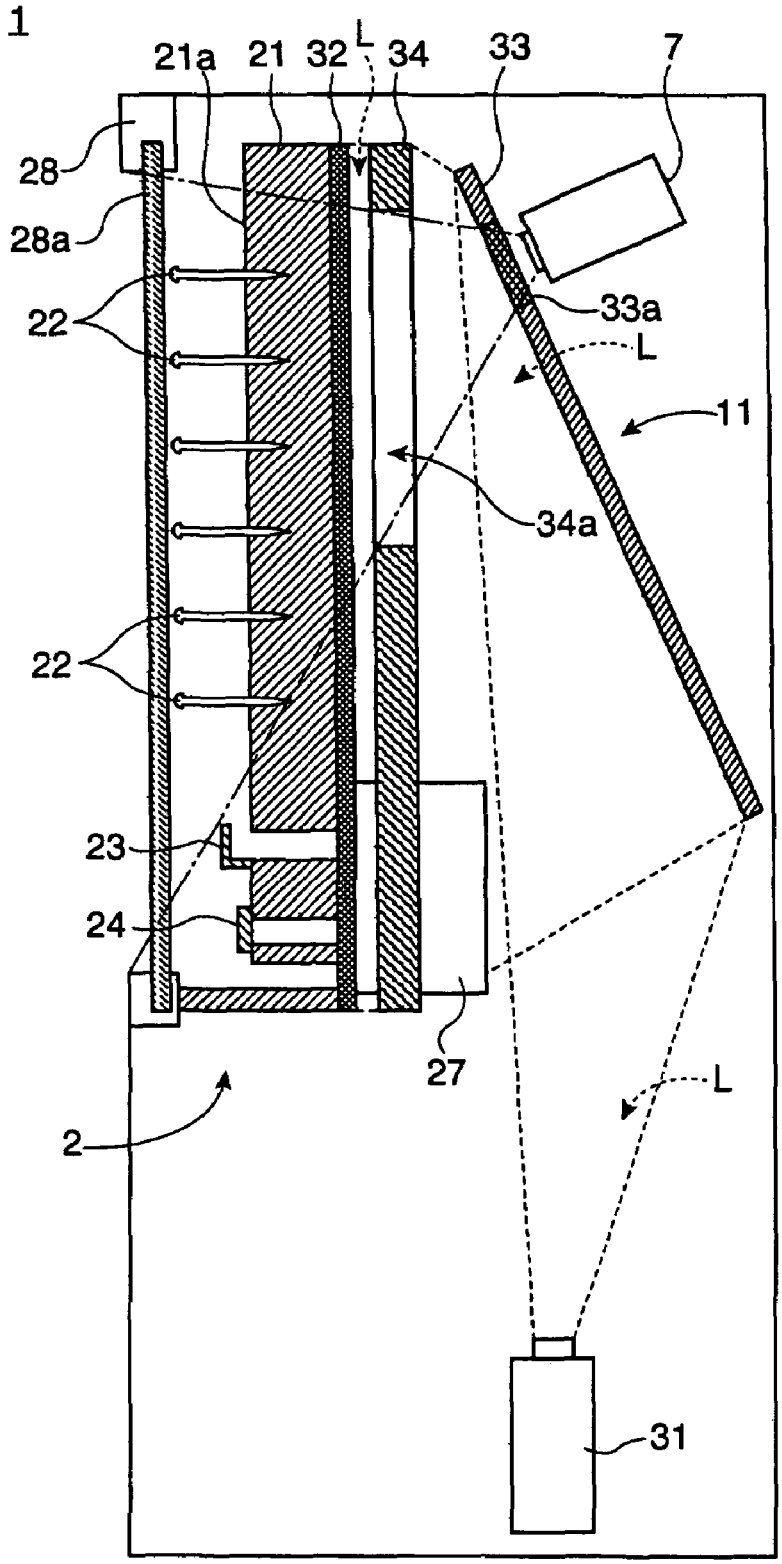
FIG. 4 is a side sectional view showing a schematic structure of the pachinko machine board.

The game mechanism 2 includes, as shown in FIG. 4, the game board 21 and an opening and closing mechanism 27. The game board 21 corresponds to the display part in the present invention and is formed with a light transmitting resin and in a rectangular shape. As shown in FIG. 3, batted balls that are movable in a circular game part 21*a* partitioned by a frame member. In this case, as shown in FIG. 4, a plurality of nails 22, 22 are fixed to the game part 21*a*. Further, such as a start chucker 23, a big prize winning port (attacker) 24, prize winning ports 25 (see FIG. 3) and windmills 26 (see FIG. 3) are arranged on the game part 21*a*. Further, a door 28 to which a transparent glass plate 28*a* is fitted is disposed in the front surface of the game board 21. Further, to the rear surface of the game board 21, a screen film 32 for projecting and displaying the image for a game Gy is secured. The opening and closing mechanism 27 is secured to the back surface of the game board 21 to open and close the big prizing winning port 24 under the control of the main control part 3.

The main control part 3 generally controls both the game mechanism 2 and the display device 5 and outputs various kinds of commands C to the display device 5 in accordance with such as a game state. Thus, the control part 3 controls the display device 5 to display the image for a game Gy or output the image pick-up data Dv. Further, the main control part 3 discriminates whether or not a player is present in front of the pachinko machine board 1 on the basis of a sensor signal S1 outputted by the user sensor 6. When the player is present in front of the pachinko machine board, the main control part 3 outputs a state informing signal S2 for informing about the presence of the player to the managing server 52.

Further, when a control signal S3 is outputted by the managing server 52, the main control part 3 outputs to the display device 5 a command C for displaying various kinds of messages in accordance with the contents of the instruction of the control signal 3. The main storing part 4 stores operation programs of the main control part 3.

The display device 5 corresponds to the image display device for a game in the present invention. As shown in FIG. 2, the display device 5 includes an image display optical part 11, a display control part 12, a RAM13, a display procedure data storing part 14, a VRAM15 and an image data storing part 16. The image display optical part 11 includes, as shown in FIG. 4, a projector unit 31, a screen film 32, a mirror 33 and a Fresnel lens 34. The projector unit 31 corresponds to the projection mechanism in the present invention and is disposed in the bottom side of the pachinko machine board 1 and emits upward the projection light L modulated on the basis of displaying image data Dg outputted by the display control part 12. Specifically, the projector unit 31 includes, for instance, a light source lamp, modulating means (as one example, a liquid crystal light bulb having a liquid crystal panel, an incident side polarizing plate and an output side polarizing plate) for modulating white light emitted by the light source lamp to the projection light L and a projection lens for enlarging and projecting the enlarged projection light L. The screen film 32 is secured to the back surface of the game board 21 to receive the projection light L (projection light L reflected by the mirror 33) projected by the projector unit 31 to form such as the image for a game Gy.

Figure 5:
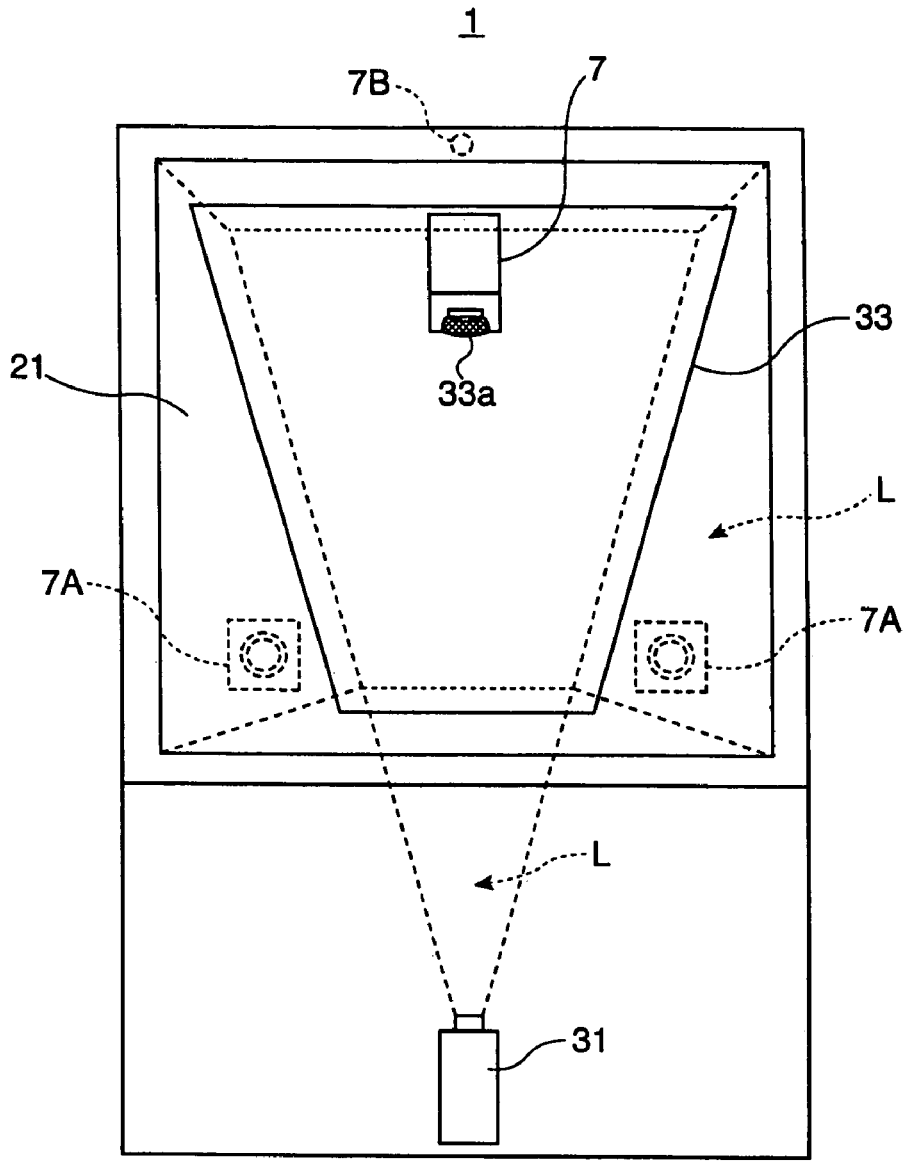
FIG. 5 is a conceptual view for explaining the form of a mirror.

The mirror 33 reflects the projection light L projected by the projector unit 31 toward the screen film 32. In this case, the mirror 33 is disposed, as shown in FIG. 4, under a state that its bottom side is separated further from the screen film 32 than its upper side. In this structure, a rectangular image for a game Gy can be projected on the screen film 32 (a back surface of the game board 21) by the projection light L projected by the projector unit 31. Further, on the mirror 33, a half-mirror part 33*a* is, as shown in FIG. 5, formed in the vicinity of a part where a camera 7 is disposed so as to pick-up the image in front (exterior) of the pachinko machine board 1 by the camera 7 disposed on the rear surface of the mirror 33. The Fresnel lens 34 converts the projection light L reflected by the mirror 33 to parallel light and projects the parallel light on the screen film 32. In this case, an image picking-up hole (or area) 34*a* is formed on the Fresnel lens 34 as shown in FIG. 4 so that the image in front of the pachinko machine board 1 can be picked-up. In FIG. 4, to easily understand the present invention, the camera 7, the half-mirror part 33*a* of the mirror 33 and the image picking-up hole 34*a* of the Fresnel lens 34 are illustrated in exaggerated sizes.

The display control part 12 corresponds the control part in the present invention and controls image pick-up data Dv outputted by the camera 7 to be outputted to the managing server 52 and stored in the image pick-up data storing part 8, as described below. Further, the display control part 12 forms displaying image data Dg for displaying the image for a game Gy in accordance with a command C outputted by the main control part 3 and outputs the data Dg to the projector unit 31. Thus, the projection light L for displaying an image is outputted. At this time, the display control part 12 extracts image data Dp in which the face of a player is drawn from the image pick-up data Dv outputted by the camera 7 when the prescribed command C is outputted by the main control part 3. Thus, the displaying image data Dg is formed by using the image data Dp. The RAM 13 temporarily stores various kinds of data formed by the display control part 12 or the calculation results of the display control part 12. The display procedure data storing part 14 stores display procedure data Ds in which the designation of image data used upon forming the displaying image data Dg, a position or size for displaying the image and the designation of display time, etc. are described and the operation program of the display control part 12. The VRAM 15 stores the displaying image data Dg formed by virtually drawing images corresponding to the image data Dp, Dp . . . by the display control part 12. The image data storing part 16 stores the image data Dp, Dp . . . (image data of images having figures drawn or backgrounds) for forming such as the displaying image data Dg.

The user sensor 6 is formed by an infrared ray sensor as one example and disposed in the front surface panel (see FIG. 3) of the pachinko machine board 1. The user sensor 6 outputs the sensor signal S1 to the main control part 3 when a player is present in front of the pachinko machine board 1. The camera 7 corresponds to the image pick-up device and a CCD camera is employed as one example. The camera 7 is disposed at the rear surface side of the mirror 33 (that is, the rear surface side of the game board 21). The camera picks-up the image of the pachinko machine board 1 from its front surface side to its exterior through the half-mirror part 33*a* of the mirror 33 and the screen film 32 under the control of the display control part 12. Then, the camera outputs the image pick-up data Dv. The image pick-up data storing part 8 is composed of a removable hard disk, as one example, to store the latest image pick-up data Dv for one hour, for example, of the image pick-up data Dv outputted by the camera 7.

The entire operation of the monitor system 51 will be described by referring to the drawings. In the monitor system 51, when the managing server 52 and the pachinko machine boards 1, 1 . . . are switched on (upon starting the monitor system 51), for instance, upon opening the pachinko parlor, the managing server 52 firstly outputs the control signal S3 which requests the pachinko machine boards 1, 1 . . . to output the image pick-up data Dv. In response thereto, each main control part 3 of each of the pachinko machine boards 1, 1 . . . initially discriminates that the player is not present in the front part thereof on the basis of the sensor signal S1 of the user sensor 6 and outputs the state informing signal S2 for informing the managing server about it to the managing server 52. Then, the main control part 3 outputs the prescribed command C (start command) to the display control part 12. In response thereto, the display control part 12 outputs a prescribed control signal to the camera 7 in accordance with the instruction of the command C to start an image pick-up operation. At this time, the camera 7 picks-up the image in front of the pachinko machine board 1 through the half-mirror part 33*a* of the mirror 33, the image picking-up hole (area) 34*a* of the Fresnel lens 34, the screen film 32, the game board 21 and the glass plate 28*a* to output the image pick-up data DV. Then, the display control part 12 outputs the image pick-up data Dv outputted by the camera 7 to the managing server 52 and controls the image pick-up data to be stored in the image pick-up data storing part 8.

Thus, the managing server 52 allows images in the parlor to be respectively displayed on the monitors of the monitoring display device 53 on the basis of the image pick-up data Dv, Dv . . . respectively outputted by the pachinko machine boards 1, 1 . . . . At this time, the managing server 52 discriminates that the players are not present in the front parts of all the pachinko machine boards 1, 1 . . . in accordance with the state informing signals S2, S2 respectively outputted by the pachinko machine boards 1, 1 . . . . At this time, the managing server 52 selects the pachinko machine boards 1 in order at intervals of several machines (for example, at intervals of three machines) from among the pachinko machine boards 1, 1 . . . arranged in the parlor (one example of the "prescribed sequence" in the present invention). The managing server switches and displays images based on the image pick-up data Dv (also refer them to as "images picked-up by the pachinko machine boards 1", hereinafter) outputted by the selected pachinko machine boards 1 on the monitoring display device 53. Thus, it takes less time when the images in all the parlor are displayed than when all the images which are respectively picked-up by the pachinko machine boards 1, 1 . . . are switched and displayed in order of the arrangement sequence of the pachinko machine boards 1, 1 . . . . Further, the managing server 52 outputs at the same time the image pick-up data Dv of the images displayed on the monitoring display device 53 to the image recording device 54. Thus, the image pick-up data Dv of the images switched and displayed on the monitoring display device 53 is recorded (recorded image) respectively by the video recorders of the image recording device 54. In this case, the managing server 52 continuously performs operations of switching, displaying and recording the images until the state informing signal S2 informing of the presence of a player is outputted by any of the pachinko machine boards 1.

The display control part 12 reads the display procedure data Ds of an initial screen from the display procedure data storing part 14 in parallel with an instruction to start an image pick-up to the camera 7. Then, the display control part 12 reads the image data Dp, Dp . . . from the image data storing part 16 in accordance with the display procedure data Ds. Then, the display control part 12 virtually draws images corresponding to the read image data Dp, Dp . . . (in this case, images of the ground, Mt Fuji and figures of "123") in the VRAM 15 to form the displaying image data Dg of the initial screen. Then, the display control part 12 outputs the displaying image data Dg in the VRAM 15 to the projector unit 31. In response thereto, the projector unit 31 modulates white color light emitted by the light source lamp to the projection light L having a shadow or color corresponding to the display image based on the outputted displaying image data Dg and emits the projection light L. At this time, the projection light L projected by the projector unit 31 is reflected by the mirror 33 and passes through the Fresnel lens 34 so that the projection light L is converted to parallel light and projected on the screen film 32. Thus, as shown in FIG. 3, the image for a game Gy as an initial screen is formed (projected and displayed) on the game board 21.

Then, when a player is seated at the pachinko machine board 1 in a non-game state, the sensor signal S1 indicating that the player is present is outputted by the user sensor 6. In response thereto, the main control part 3 outputs the state informing signal S2 informing of the presence of the player to the managing server 52. At this time, when the number of the pachinko machine boards 1 in which the players are present in front thereof is small, the managing server 52 preferentially selects the pachinko machine boards 1 selected when the above-described pachinko machine boards are selected at intervals of several machines (another example of the "prescribed sequence" in the present invention). Thus, the managing server 52 preferentially displays the images picked-up by the pachinko machine boards 1 in which the players are present on the monitoring display device 53. Further, when the number of the pachinko machine boards 1 in which the prayers are present is large, the managing server 52 selects the pachinko machine boards disposed at intervals of several machines irrespective of the presence or absence of the players and switches and displays the images respectively picked-up by the selected pachinko machine boards 1. Then, the managing server 52 preferentially selects other pachinko machine boards 1, 1 . . . that are different from the pachinko machine, which finished displaying the image, and switches and displays each image. A selection sequence as to which image is displayed among the images respectively picked-up by the pachinko machine boards 1, 1 . . . is predetermined and recorded in the managing server 52 as an operation program. Accordingly, the managing server 52 sequentially switches and displays the images respectively picked-up by the pachinko machine boards 1, 1 . . . on the monitors of the monitoring display device 53 in accordance with the contents of description of the operation program, except when a prescribed pachinko machine board 1 is selected by an operator as described below.

When an abnormality is detected in the image displayed on the monitoring display device 53 (for instance, a figure of a player who tries to do an illegal action), the pachinko machine board 1 in which the image is picked-up is selected by operating the operating part of the managing server 52. At this time, the managing sever 52 fixedly displays the image picked-up by the selected pachinko machine board 1 on any one of the monitors of the monitoring display device 53 and switches and displays the images picked-up by other pachinko machine boards 1, 1 . . . on the remaining five monitors. Thus, while for instance, a person who performs an illegal action is monitored, other places in the parlor can be monitored in order. In this case, in the monitor system 51, the image displayed on the monitoring display device 53 is picked-up by the camera 7 disposed in the back surface side of the game board 21 (mirror 33). Accordingly, an image of the behavior of the player can be picked-up and displayed on the monitoring display device 53 without making the player notice the presence of the camera 7. Further, even when the player recognizes the presence of the camera 7, if a shield object (persons or articles) for interrupting the image pick-up operation is interposed between the game board 21 and the player himself (or herself), the player can hardly see the image for a game Gy projected and displayed on the game board 21. Therefore, the player is actually incapable of performing an illegal action while he or she interrupts the image picking-up operation by the camera 7. Consequently, a person who recognizes the presence of the camera 7 stops the illegal action.

Figure 6:
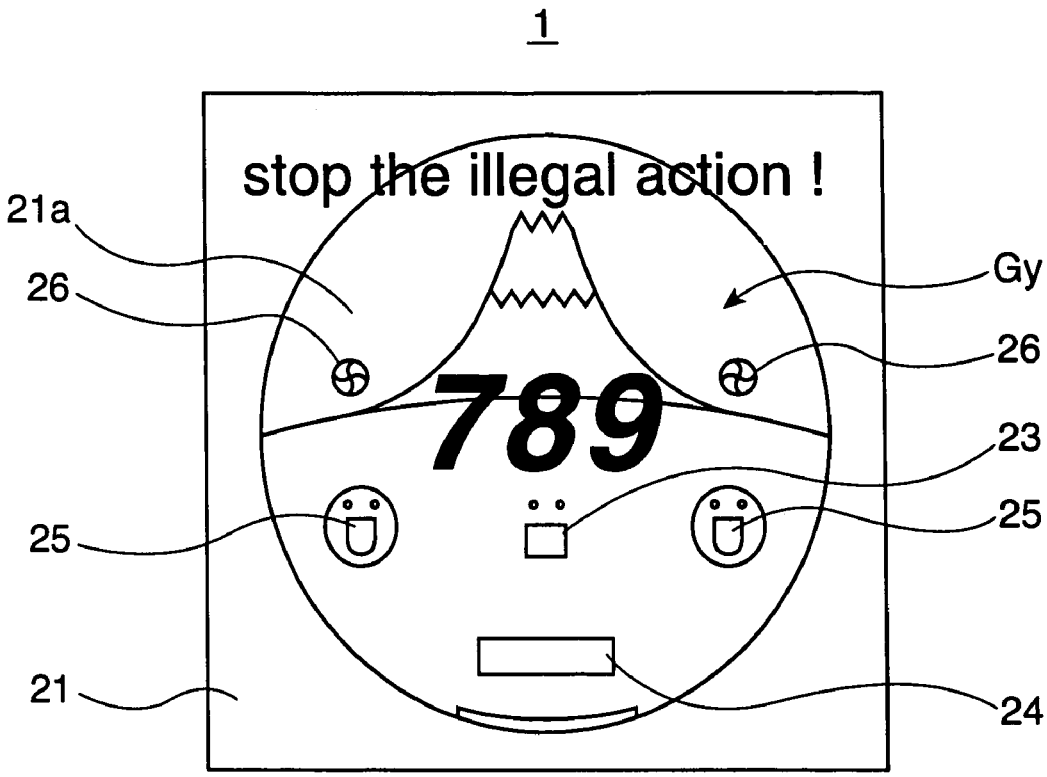
FIG. 6 is a display screen view showing one example of an image for a game Gy in which a message for a player is synthesized.

When the illegal action is recognized from the displayed image on the monitoring display device 53, a message for the player is displayed on the game board 21 of the pachinko machine board 1 by operating the operating part of the managing server 52. Specifically, when the pachinko machine board 1 on which the message is to be displayed is instructed (operated) by an operator, the managing server 52 outputs the control signal S3 for instructing the display of the message to the pachinko machine board 1. In the pachinko machine board 1, the main control part 3 outputs, in response thereto, the command C for instructing the display of the message to the display control part 12. The display control part 12 reads out the image data Dp of an image on which the character string of the message is written from the image data storing part 16 in accordance with the command C. Then, the display control part 12 forms the displaying image data Dg in the VRAM 15 on the basis of the image data Dp for displaying the message and the image data Dp, Dp . . . for displaying the ordinary image Gy for a game and outputs the displaying image data Dg to the projector unit 31. Thus, as shown in FIG. 6, the image for a game Gy in which the character string of "stop the illegal action !" is written is projected and displayed as one example. As a result, the player who sees the message stops the illegal action.

When a suspicious person wandering about the parlor is detected in any of the images, the figure of the suspicious person may be followed and fixedly displayed on any one of the monitors. Specifically, at this time, the nearest pachinko machine board 1 is selected in order to follow the movement of the suspicious person. The images picked-up by the selected pachinko machine boards 1 are switched and displayed on the monitoring display device 53. In this case, in the monitor system 51, the images in front (exterior) of the pachinko machine boards 1, 1 . . . are picked-up by the cameras 7 respectively incorporated in all of the pachinko machine boards 1, 1 . . . . Therefore, even when the suspicious person moves to any place in the parlor, the image of his or her figure can be picked-up by any of the pachinko machine boards 1.

In the pachinko machine board 1, when what is called a premium reach (a state that initially stationary two picture patterns are matched in a special picture pattern) is displayed, the image of the face of the player picked-up by the camera 7 is projected and displayed on the game board 21 as a part of the image for a game Gy. Specifically, the main control part 3 firstly outputs the command C for instructing the display of the image for a game Gy upon premium reach. In response thereto, the display control part 12 reads the display procedure data Ds from the display procedure data storing part 14 in accordance with contents instructed by the command C. Then, the display control part 12 reads the image data Dp, Dp . . . stored in the image data storing part 16 in accordance with the display procedure data Ds. Further, the display control part 12 extracts the image data in which the image of the face of the player is picked-up from the image pick-up data Dv stored in the image pick-up data storing part 8 and performs an image process to this image data to form the image data Dp of the image with the face of the player drawn. Subsequently, the display control part 12 forms the displaying image data Dg for displaying the image for a game Gy in the VRAM 15 by using the thus obtained image data Dp and the image data Dp, Dp . . . read from the image data storing part 16. At this time, the display control part 12 uses, for instance, the image on which the face of the player is drawn as the picture patterns of reels (reels for a reach state) at both right and left ends of three reels in the image for a game Gy.

Figure 7:
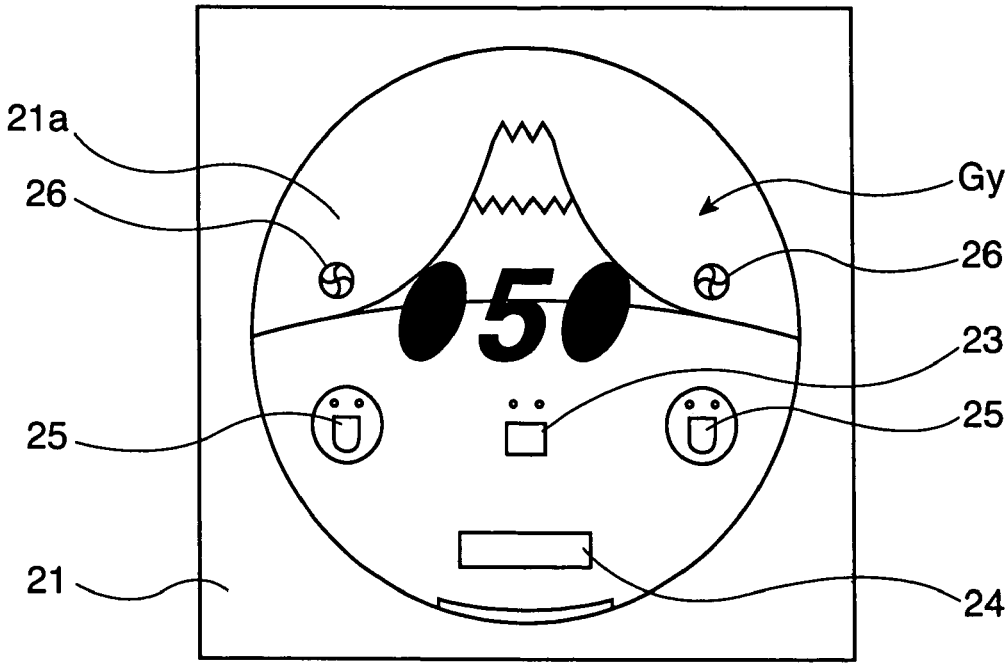
FIG. 7 is a display screen view showing one example of an image for a game Gy upon premium reach.

Then, the display control part 12 outputs the displaying image data Dg in the VRAM 15 to the projector unit 31. In response thereto, the projector unit 31 modulates light to the projection light L for displaying the image based on the displaying image data Dg outputted by the display control part 12 and emits the projection light L. Thus, as shown in FIG. 7, the image for a game Gy in which the face of the player is displayed on the reels at both the right and left ends of the three reels to obtain a reach state is projected and displayed on the game board 21. In FIG. 7, parts in which the face of the player is displayed are represented by "•" (black mark painted out in black). After that, the display control part 12 variably displays a reel at a center (a reel in which "5" is displayed in FIG. 7), and then, the display control part stops and displays a stop picture pattern designated by the main control part 3. At this time, when the main control part 3 instructs a picture pattern as a big hit to be stopped and displayed, the display control part 12 stops and displays the image in which the face of the player is drawn in the central reel. On the other hand, when a miss is instructed after the reach state, the display control part 12 stops and displays the image in which a figure (in this case, any FIGS. of "1" to "9") except the face of the player is drawn in the central reel.

As described above, according to the pachinko machine board 1 and the monitor system 51, the display control part 12 outputs the image pick-up data Dv picked-up by the camera 7 to the managing server 52. The managing server 52 displays the images respectively picked-up by the pachinko machine boards 1, 1 . . . on the monitors of the monitoring display device 53. Therefore, the images of the players situated in the front of the pachinko machine boards 1 can be reliably picked-up and respectively displayed on the monitors of the monitoring display device 53 without interrupting an image pick-up operation. The above-described monitor system is different from a conventional monitor system in which the image is picked-up by the monitor camera disposed in the vicinity of the ceiling in the parlor. Accordingly, the images of unjust actions performed in front of the pachinko machine boards 1 can be reliably picked-up and respectively displayed on the monitors of the monitoring display device 53. Further, the pachinko machine board 1 has the image pick-up data storing part 8 for storing the image pick-up data Dv. Accordingly, when, for instance, the unjust action is performed, the image pick-up data Dv in which the image of the unjust action is picked-up can be used as evidence. When prescribed conditions are satisfied (as one example, when the image for a game Gy as a premium reach is instructed to be displayed), the display control part 12 displays, for instance, the image of the face of the player extracted from the image pick-up data Dv recorded in the image pick-up data storing part 8 as a part of the image for a game Gy. Therefore, it is possible to display the image for a game Gy in more various patterns, compared with a display method in which the image for a game Gy is displayed only by using the prepared image data. Thus, the weariness of the player can be prevented from arising.

Further, according to the pachinko machine board 1, the display device 5 has the projector unit 31 provided for projecting and displaying the image for a game Gy on the game board 21 from the rear surface side. The camera 7 picks-up the image of the outer surroundings (front surface side) of the pachinko machine board 1 through the game board 21 from the rear surface side of the game board 21. Accordingly, the image can be picked-up while the player does not recognize the existence of the camera 7. Even when the camera 7 is installed for each of the pachinko machine boards 1, 1 . . . the parlor can be monitored without giving any discomfort to the players. Further, since the front surface side (such as the face of the player) of the pachinko machine board 1 can be brightly illuminated by the projection light L for projecting and displaying the image for a game Gy, the clear image can be picked-up.

Further, in the monitor system 51, the managing server 52 switches and displays the images respectively picked-up by the pachinko machine boards 1, 1 . . . on the monitors of the monitoring display device 53 in the prescribed sequence. Since the images picked-up by the pachinko machine boards 1, 1 . . . can be displayed by the small number of monitors, the parlor can be entirely monitored at low cost. Further, in the monitor system 51, the managing server 52 displays the image picked-up by the pachinko machine board 1 selected by the operation of the operating part thereof on the monitoring display device 53. Accordingly, for instance, the pachinko machine board I which picks-up the image of a suspicious person is selected so that the behavior of the suspicious person can be continuously monitored. Thus, the illegal action is prevented from being performed. Still further, in the monitor system 51, the image recording device 54 for storing the image pick-up data Dv respectively outputted by the pachinko machine boards 1, 1 . . . is provided. Accordingly, for instance, when the illegal action is performed, the image pick-up data Dv obtained by picking-up the action can be employed as evidence.

Figure 8:
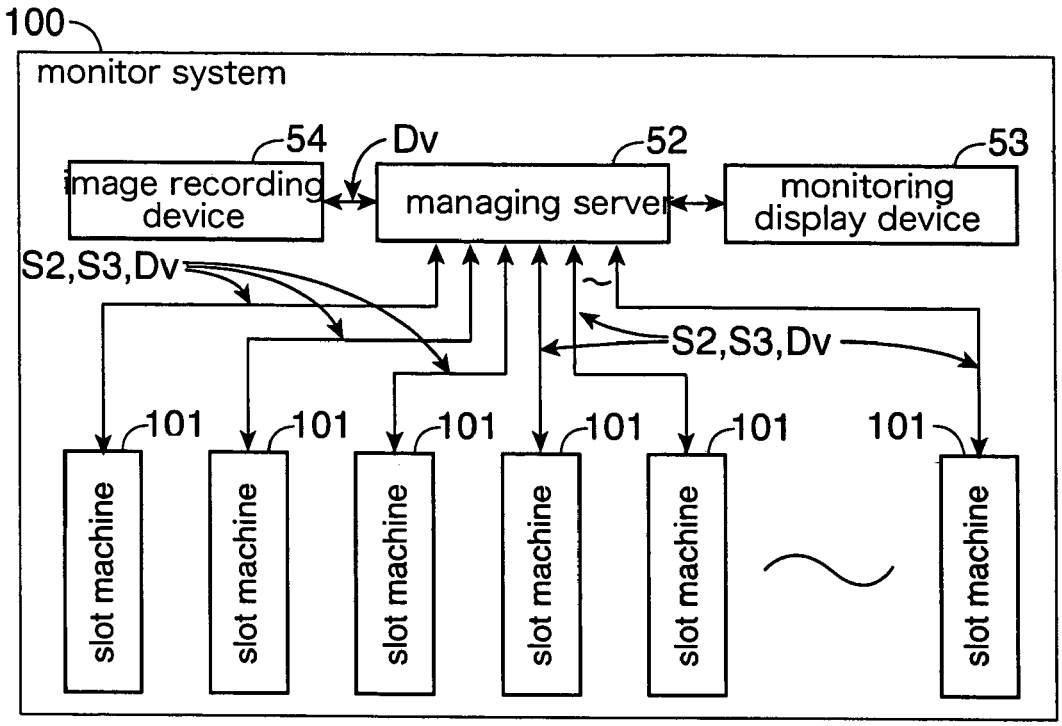
FIG. 8 is a block diagram showing the structure of a monitor system.

Now, a monitor system 100 according to another embodiment of the present invention will be described by referring to the drawings. To the monitor system 100 or a below-described monitor system 200, the present invention is basically applied like the monitor system 51. Therefore, the same components as those of the monitor system 51 are designated by the same reference numerals and a duplicated explanation thereof is omitted. The monitor system 100 includes, as shown in FIG. 8, a plurality of slot machines (game machines) 101, 101, . . . disposed in, for instance, the hall of a game place, a managing server 52 disposed in a managing room, a monitoring display device 53 and an image recording device 54 connected to the managing server 52.

Figure 9:
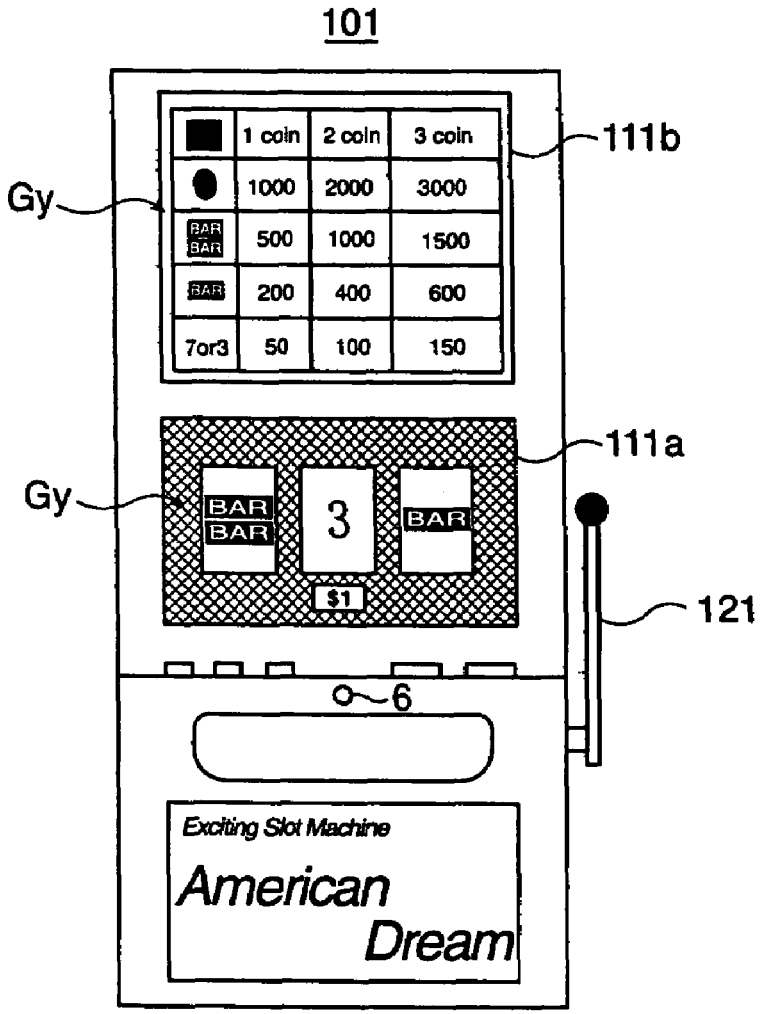
FIG. 9 is a front view showing the structure of a slot machine.
Figure 10:
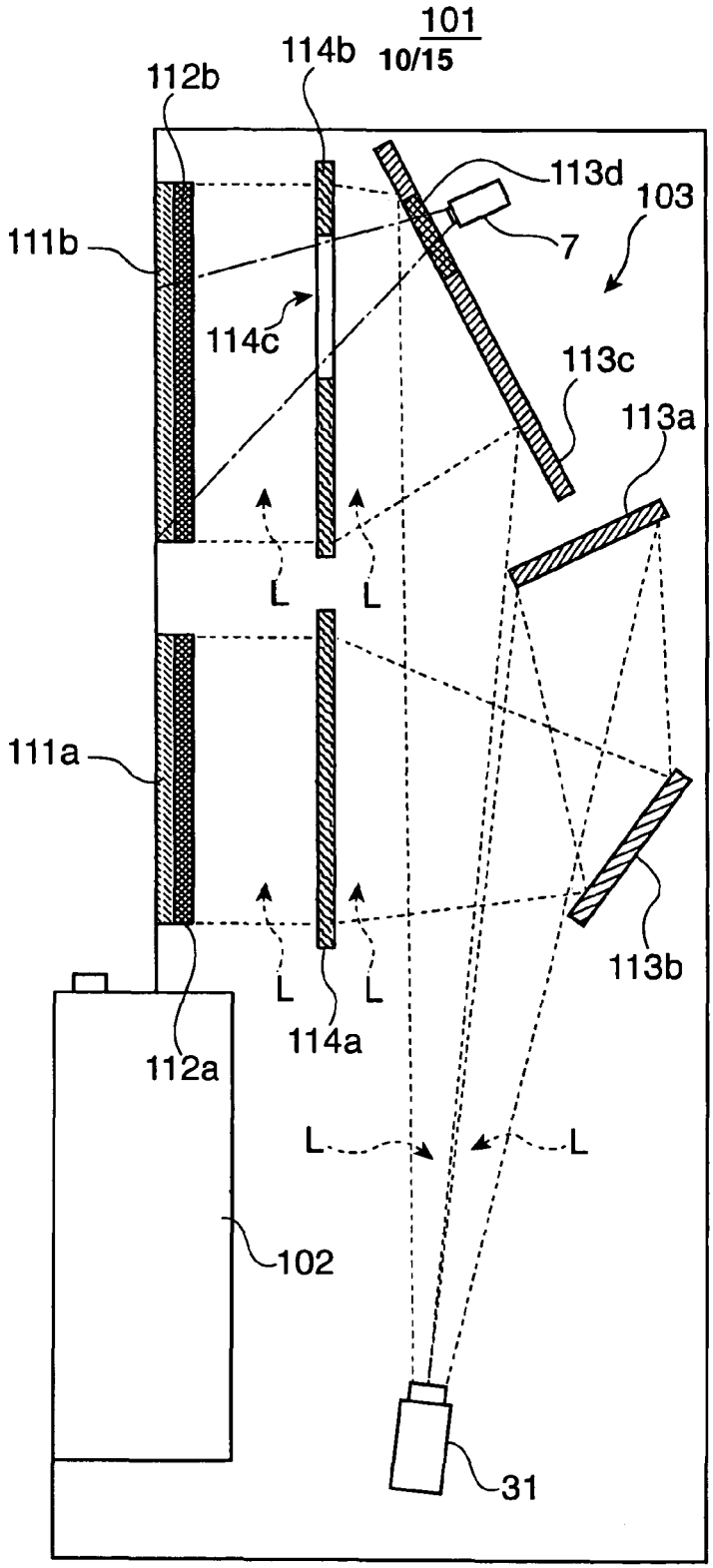
FIG. 10 is a side sectional view showing the schematic structure of the slot machine.

As shown in FIG. 9, the slot machine 101 projects and displays, in accordance with a rear projection system, various kinds of images for a game Gy (for instance, images for a game Gy including images imitating reels shown in FIG. 9 or images for a game Gy showing the number of paid coins) on display panels (correspond to display parts in the present invention) 111*a* and 111*b* provided in the front part of a machine main body. The image of the slot machine 101 from a front surface side to an outer part is picked-up and image pick-up data Dv can be outputted to the managing server 52. In this case, the slot machine 101 includes a game mechanism 102 and an image display optical part 103 provided in the machine main body, as shown in FIG. 10. The game mechanism 102 serves to return coins (medals) under the control of a main control part 3.

The image display optical part 103 includes, as shown in FIG. 10, screen films 112*a* and 112*b* respectively secured to the back surfaces of the display panels 111*a* and 111*b* made of a light transmitting resin, mirrors 113*a*, 113*b* and 113*c*, Fresnel lenses 114*a* and 114*b* and a projector unit 31. In this case, the mirrors 113*a* and 113*b* reflect a part of projection light L projected by the projector unit 31 toward the Fresnel lens 114*a* (screen film 112*a*). Further, the mirror 113*c* reflect a part of the projection light L toward the Fresnel lens 114*b* (screen film 112*b*). Further, as shown in FIG. 10, on the mirror 113*c*, a half-mirror part 113*d* is formed near a part in which a camera 7 is installed so that the image in front of the slot machine 101 can be picked-up by the camera 7 disposed in the rear surface thereof. Further, the Fresnel lens 114*b* is provided with an image picking-up hole (area) 114*c* so that the image in front of the slot machine 101 can be picked-up by the camera 7.

In this monitor system 100, when the managing server 52 and the slot machines 101, 101 . . . are switched on, for instance, upon opening the game place, the managing server 52 outputs a control signal S3 to the slot machines 101, 101, . . . respectively in the same manner as that of the monitor system 51. In response thereto, the slot machines 101, 101, . . . respectively output state informing signals S2 that players are not present in front of the machines to the managing server 52. Then, the main control part 3 of each slot machine 101 outputs a starting command C. In response thereto, a display control part 12 allows the camera 7 to start an image pick-up operation. At this time, the camera 7 picks-up the image in front of the slot machine 101 through the half-mirror part 113*d*, the image picking-up hole 114*c*, the screen film 112*b* and the display panel 111*b* to output the image pick-up data Dv.

Then, the managing server 52 allows the images of the parlor to be respectively displayed on the monitors of the monitoring display device 53 on the basis of the image pick-up data Dv, Dv . . . respectively outputted by the slot machines 101, 101 . . . . At this time, the managing server 52 discriminates that the players are not present in the front parts of all the slot machines 101, 101 . . . in accordance with the state informing signals S2, S2 . . . respectively outputted by the slot machines 101, 101 . . . . At that time, the managing server 52 switches and displays on the monitoring display device 53 the images (also refer them to as images picked-up by the slot machines 101", hereinafter) based on the image pick-up data Dv outputted by the slot machines 101 selected in order at intervals of several machines (for example, at intervals of three machines) from among the slot machined 101, 101 . . . arranged in the parlor. Further, the managing server 52 outputs at the same time the image pick-up data Dv of the images displayed on the monitoring display device 53 to the image recording device 54.

The display control part 12 of the slot machine 101 forms displaying image data Dg of an initial screen in parallel with an instruction to start an image pick-up to the camera 7 and outputs the displaying image data Dg to the projector unit 31. Then, the projector unit 31 emits the projection light L based on the outputted displaying image data Dg. At this time, as shown in FIG. 10, the projected projection light L is reflected. respectively by the mirrors 113*a*, 113*b* and 113*c*, converted to parallel light by the Fresnel lenses 114*a* and 114*b* and projected respectively on the screen films 112*a* and 112*b*. Thus, as shown in FIG. 9, the images Gy and Gy for a game as the initial screens are respectively projected and displayed on the display panels 111*a* and 111*b*.

Then, when a player is seated at the slot machine 101,the main control part 3 of the slot machine 101 outputs the state informing signal S2 informing of the presence of the player on the basis of a sensor signal S1 outputted by a user sensor 6 (see Fig, 9) to the managing server 52. At this time, when the number of the slot machines 101 in which the players are present in front thereof is small, the managing server 52 preferentially selects the slot machines 101 selected when the above-described slot machines 101 are selected at intervals of several machines. Thus, the managing server 52 preferentially displays the images picked-up by the slot machines 101 in which the players are present on the monitoring display device 53.

When a player who tries to do an illegal action is detected from the images displayed on the monitoring display device 53, the slot machine 101 in which the image is picked-up is selected by operating the operating part of the managing server 52. At this time, the managing sever 52 fixedly displays the image picked-up by the selected slot machine 101 on any one monitor of the monitoring display device 53. In this case, in the monitor system 100 like the monitor system 51, the image displayed on the monitoring display device 53 is picked-up by the camera 7 disposed in the back surface side of the display panel 111*b* (mirror 113*c*). Accordingly, the image of the behavior of the player can be picked-up without making the player notice the presence of the camera 7.

Figure 11:
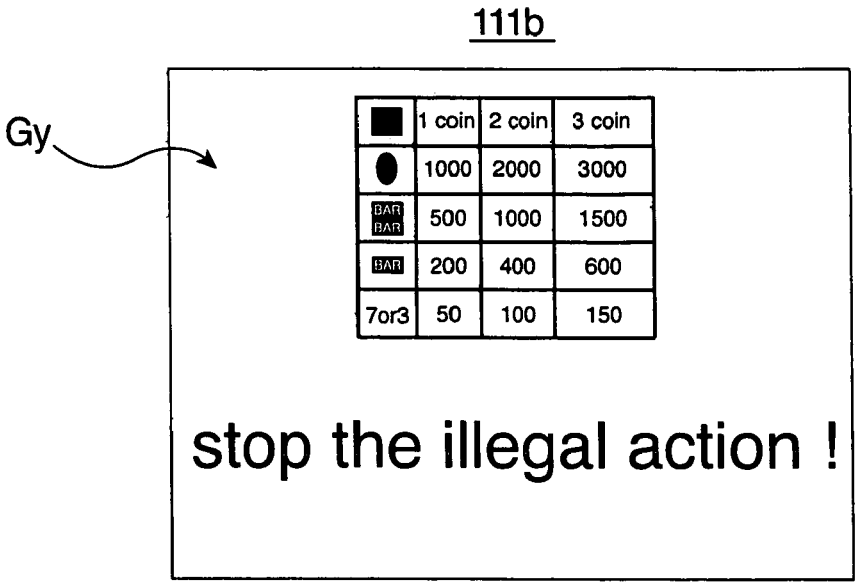
FIG. 11 is a display screen view showing one example of an image for a game Gy in which a message for a player is synthesized.

When the illegal action is recognized from the displayed image on the monitoring display device 53, a message for the player is displayed on the slot machine 101 that picks-up the image by using an operation part of the managing server 52. Specifically, when the an operation for instructing the message to be displayed is performed, the managing server 52 outputs the control signal S3 for instructing the display of the message to the slot machine 101 as an object on which the message is to be displayed. The main control part 3 of the slot machine 101 outputs the command C for instructing the display of the message. Then, the display control part 12 forms the displaying image data Dg for displaying the message in accordance with the command C and outputs the displaying image data Dg to the projector unit 31. Thus, as shown in FIG. 11, the image for a game Gy in which the character string of "stop the illegal action !" is written is projected and displayed on the display panel 111*b* as one example. As a result, the player who sees the message stops the illegal action.

In the slot machine 101, when, for instance, a big hit (a hit in which the number of paid coins is the largest) is generated, the image of the face of the player picked-up by the camera 7 is projected and displayed on the display panel 111*a* as a part of the image for a game Gy. Specifically, when the big hit is generated, the main control part 3 outputs the command C for instructing the display of the image for a game Gy for the big hit. In response thereto, the display control part 12 extracts the image data in which the image of the face of the player is picked-up from image pick-up data Dv stored in an image pick-up data storing part 8 to form image data Dp. Further, the display control part 12 forms the displaying image data Dg for displaying the image for a game Gy for the big hit in a VRAM 15 by using the image data Dp and image data Dp, Dp . . . read from an image data storing part 16.

Figure 12:
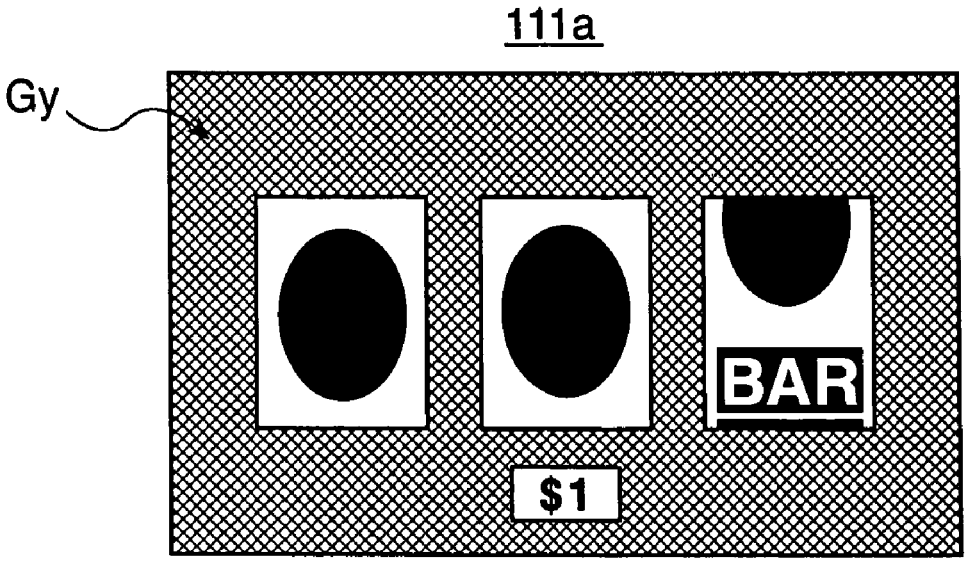
FIG. 12 is a display screen view showing one example of an image for a game Gy upon big hit.

Then, the display control part 12 outputs the displaying image data Dg to the projector unit 31. The projector unit 31 projects the projection light L based on the displaying image data Dg. Thus, for instance, as shown in FIG. 12, the image for a game Gy in which the image of the face of the player is displayed in a stationary state at the left and central reels of three reels to obtain a reach state is projected and displayed on the display panel 111*a*. After that, the image for a game Gy for the big hit in which the scrolling speed of the right reel is gradually lowered and stops under a state that the image of the face of the player is displayed is projected and displayed on the display panel 111*a*. In FIG. 12, parts in which the face of the player is displayed are represented by "•" (black mark painted out in black).

As described above, according to the slot machine 101 and the monitor system 100, the managing server 52 displays the images respectively picked-up by the slot machines 101, 101 . . . on the monitors of the monitoring display device 53. Therefore, the images of the players situated in front of the slot machines 101 can be reliably picked-up without interruption of an image pick-up operation. Accordingly, the images of unjust actions performed in front of the slot machines 101 can be reliably picked-up and respectively displayed on the monitors of the monitoring display device 53. When prescribed conditions are satisfied (as one example, when the big hit is generated), for instance, the image of the face of the player extracted from the image pick-up data Dv is displayed as a part of the image for a game Gy, so that the image in more various patterns can be displayed. Further, the camera 7 picks-up the image of the outer part of the slot machine 101 through the display panel 111*b* from the rear surface side of the display panel 111*b*.

Thus, since the image can be picked-up without making the player notice the presence of the camera 7, even when the camera 7 is installed for each of the slot machines 101, 101 . . . , the parlor can be monitored without giving any discomfort to the players.

The slot machine in the monitor system 100 is not limited to the above-described structure. For example, a slot machine may include mechanical type reels actually rotating in accordance with the operation of a handle 121 (see FIG. 9) in place of the display of the images for a game Gy having the images imitating the reels. In this case, image Gy for a game for representing a big hit including the image of the face of a player is projected and displayed on a display panel (a display panel corresponding to the display panel 111*b* in the slot machine 101) upon generation of the big hit. Thus, a presentation in more various patterns can be realized like the slot machine 101.

Figure 13:
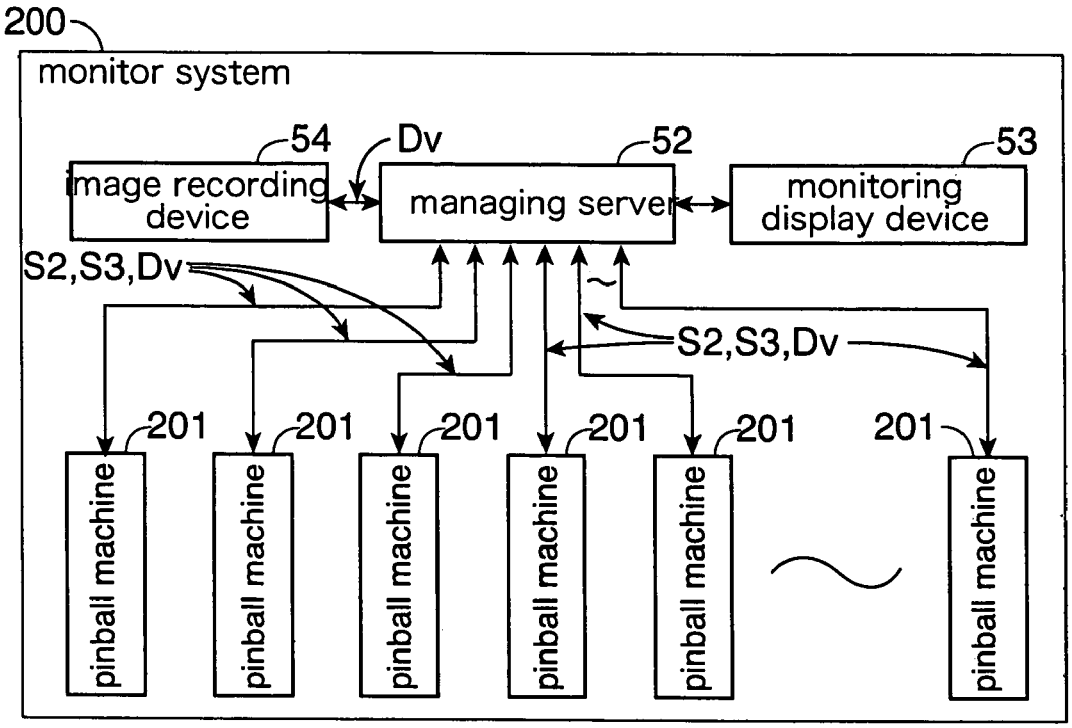
FIG. 13 is a block diagram showing the structure of a monitor system.
Figure 14:
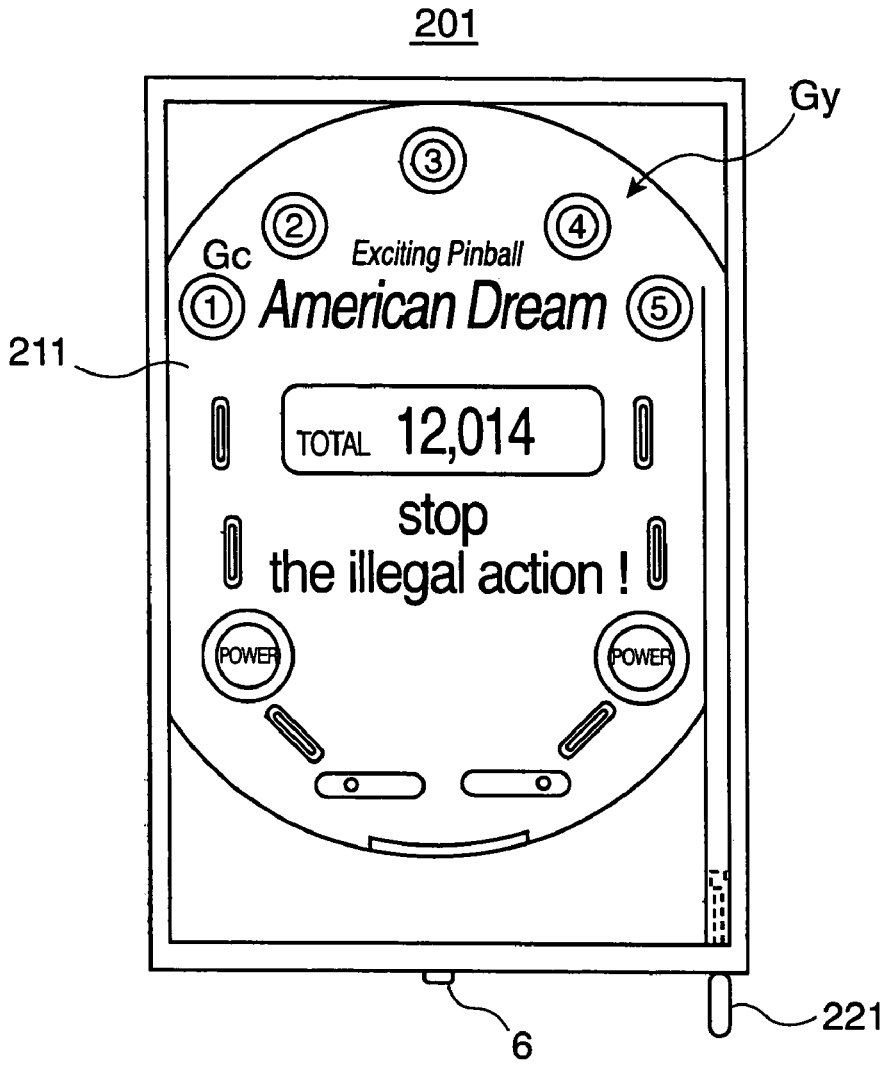
FIG. 14 is a plan view showing the schematic structure of a pinball machine.
Figure 15:
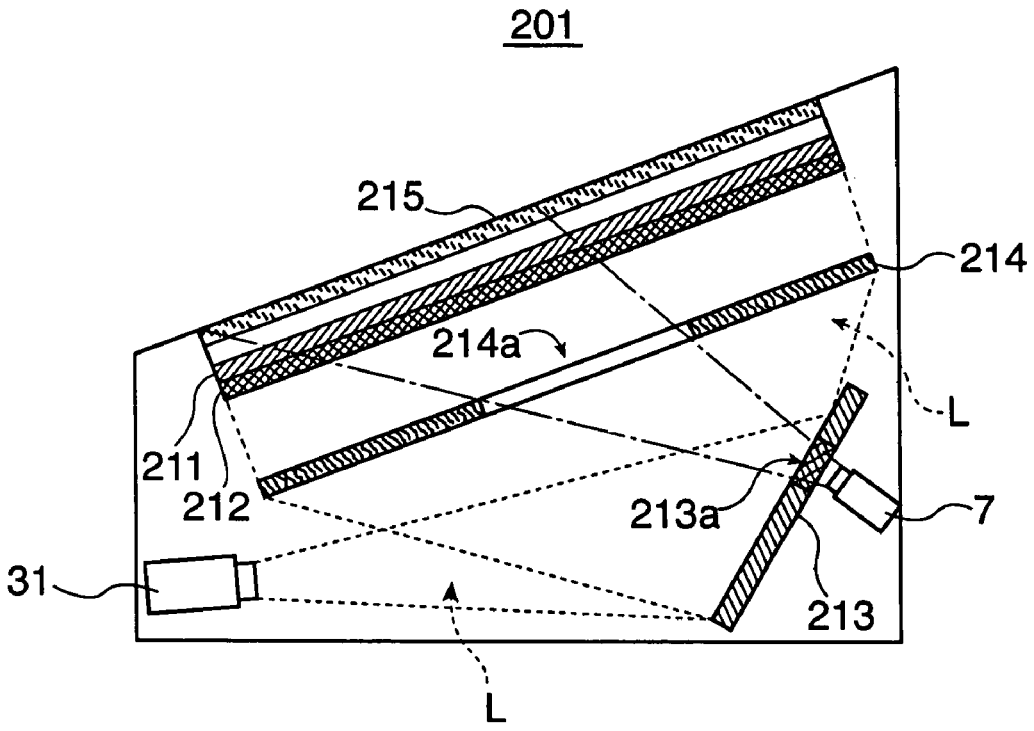
FIG. 15 is a side sectional view showing the schematic structure of the pinball machine.

In the monitor system according to the present invention, a monitor system including such as a pinball machine is included as well as the monitor systems 51 and 100. For instance, a monitor system 200 shown in FIG. 13 comprises a plurality of pinball machines (game machines) 201, 201, . . . a managing server 52, a monitoring display device 53 and an image recording device 54 connected to the managing server 52. In the pinball machine 201, as shown in FIGS. 14 and 15, images for a game Gy including images indicating a score or background picture patterns (in this case, characters (American Dream) showing such as the name of machine of the pinball machine 201) are projected and displayed by a rear projection system on a game board 211 to which various kinds of accessories are attached and disposed on the upper surface side of a machine main body. The image of the pinball machine 201 is picked-up from a front surface side to an outer part so that image pick-up data can be outputted to the managing server 52. The pinball machine 201 includes, as shown in FIG. 15, a screen film 212 secured to the back surface of the game board 211, a mirror 213, a Fresnel lens 214 and a projector unit 31. In this case, as shown in FIG. 15, the mirror 213 is provided with a half-mirror part 213*a* by which the image in front of the pinball machine 201 can be picked-up by a camera 7 disposed in the rear surface thereof. Further, the Fresnel lens 214 is provided with an image picking-up hole 214*a* by which the image in front of a slot machine 101 can be picked-up by the camera 7. In the pinball machine 201, a ball is moved between the game board 211 and a glass plate 215 disposed on the upper surface of the machine main body to play a pinball game.

In the monitor system 200, the managing server 52 displays, in the same manner as those of the monitor systems 51 and 100, images in a parlor (also refer them to as "images picked-up by the pinball machines 201", hereinafter) based on image pick-up data Dv, Dv . . . outputted by the pinball machines 201 selected in a prescribed sequence from among the pinball machined 201, 210, . . . on the monitors of the monitoring display device 53. At this time, the managing server 52 changes the sequence of selection in accordance with the number of players present in front of the pinball machines 201, 201, . . . . Further, when a specific pinball machine 201 is selected by the operation of an operating part, the managing server 52 fixedly displays the image picked-up by the pinball machine 201 on any one of monitors. Further, when an operation for displaying a message is performed, the managing server 52 outputs a control signal S3 for instructing the display of the message to the pinball machine 201 on which the message is to be displayed. In response thereto, the main control part 3 of the pinball machine 201 on which the message is to be displayed outputs a command C. A display control part 12 forms displaying image data Dg for displaying the message in accordance with the command C and outputs the displaying image data Dg to the projector unit 31. Thus, as shown in FIG. 14, an image for a game Gy including a character string of "stop the illegal action !" is projected and displayed on the game board 211 as one example.

On the other hand, in the pinball, machine 201, for instance, when the score exceeds a prescribed score, an image Gy (not shown) for a game for presentation including the image of the face of a player picked-up by the camera 7 is projected and displayed on the game board 211. In the monitor system 200, the image of the player situated on the front surface side of the pinball machine 201 can be reliably picked-up without interruption of an image pick-up operation like the monitor systems 51 and 100. Accordingly, the illegal action performed on the front surface side of the pinball machine 201 can be reliably picked-up and displayed on each monitor of the monitoring display device 53. Further, the camera 7 picks-up the image of the outer part of the pinball machine 201 through the game board 211 from the rear surface side of the game board 211. Thus, the image of the pinball machine can be picked-up while the player does not recognize the presence of the camera 7. Accordingly, the parlor can be monitored without giving any discomfort to the players. Further, when prescribed conditions are satisfied (as one example, when the score exceeds a prescribed score), for instance, the image of the face of the player is displayed as a part of an image for a game Gy. Thus, the image for a game Gy high in its interest can be displayed.

Further, the present invention is not limited to the above-described embodiments. In the embodiments of the present invention, although the presence and absence of the player are discriminated on the basis of the sensor signal S1 outputted by the user sensor 6, the present invention is not limited thereto. For example, the handle 29 (see FIG. 3) of the pachinko machine board 1, the handle 121 (see FIG. 9) of the slot machine 101 and the handle 221. (see FIG. 14) of the pinball machine 201 may be provided with sensors. Thus, whether or not a hand touches these handles may be detected to discriminate the presence and the absence of the player. Further, weight sensors may be provided on the chairs for a game which are disposed in front of the pachinko machine boards 1, the slot machines 101 and the pinball machines 201. Then, whether or not the player is present may be discriminated on the basis of the sensor signal of the weight sensor. Further, the user sensor 6 is not limited to the infrared ray sensor and may be formed with various kinds of sensors such as an optical sensor. Additionally, the discrimination between the presence and the absence of the player by such as the user sensor 6 does not constitute an essential requirement and may be omitted if desired. The images picked-up by the pachinko machine boards 1, 1 . . . , the slot machines 101, 101 . . . and the pinball machines 201, 201 . . . may be switched and displayed on the monitoring display device 53 irrespective of the presence and absence of the player.

In the embodiments of the present invention, an example that the mirror 33 has the half-mirror part 33*a* and the camera 7 is disposed in the rear surface side of the mirror 33 is described. However, the place where the image pick-up device in the present invention is installed is not limited thereto. For example, as shown in FIG. 5, a camera 7A may be installed at a position on either side of the mirror 33 (or offset therefrom (through the use of mirrors and the like) to pick-up the image in of the pachinko machine board 1 by the camera 7A. In this case, as shown in FIG. 5, when a structure that the projection light L is emitted upward from the projector unit 31 is employed, the mirror 33 may be formed in a trapezoidal shape in which a side (bottom side) near the projector unit 31 is short. Accordingly, the camera 7A can be installed in either of both the sides of the mirror 33 and the installed camera 7A can pick-up the image in front of the pachinko machine board without interrupting the projection of the projection light L. According to this structure, the half-mirror part 33*a* does not need to be formed for the mirror 33. Accordingly, the manufacture cost of the pachinko machine board 1 can be reduced more by the manufacture cost of the mirror 33. In this case, also in the slot machine, the camera may be installed on either side of the mirror 113*c* to pick-up the image in front of the slot machine by the camera. In the pinball machine, the camera may be likewise installed on either side of the mirror 213. Still further, in the embodiments of the present invention, although an example that the camera 7 is disposed at the rear surface side of the game board 21 is described, the present invention is not limited thereto. As shown in FIG. 5, a camera 7B may be installed on the front surface of the pachinko machine board (as one example, an upper edge of the door 28) to pick-up an image. According to this structure, since the player can apparently recognize the existence of the camera 7B (a fact that the image of the player himself (or herself) is picked-up), the illegal action by the player can be prevented. In this case, in the slot machine, a structure that the camera is installed in front of the machine to pick-up an image may be also employed. Further, in the pinball machine, a structure that the camera is installed on the upper surface thereof to pick-up an image may be also employed.

Further, in the embodiments of the present invention, the pachinko machine board 1, the slot machine 101 and the pinball machine 201 formed so as to project and display the image for a game Gy by the rear projection system are described as examples. However, the structure of the game machine according to the present invention is not limited thereto. For example, a structure may be employed in which a liquid crystal display unit is disposed on the central part of the game board (or in place of the display panel) to display the image for a game Gy on the liquid crystal display unit. When this structure is used, for instance, an image pick-up device such as a CCD camera is disposed in the front surface of the pachinko machine board or the slot machine and the upper surface of the pinball machine to pick-up the image of the pachinko machine board from its front surface side to its outer part by the image pick-up device. Thus, the image of the illegal action can be picked-up and displayed on the monitoring display device 53 like the above-described pachinko machine board 1, the slot machine 101 and the pinball machine 201.

In the embodiments of the present invention, when the suspicious person is followed and displayed on the monitoring display device 53, the method for selecting the pachinko machine board 1 by the operator is described. However, a method may be employed in which an image analysis program is installed in the managing server 52 and the managing server 52 analyzes the moving direction of the suspicious person to automatically select the nearest pachinko machine board 1. Further, in the embodiments of the present invention, an example is described in which when the main control part 3 outputs the command C for displaying the image for a game Gy in a premium reach state, the pachinko machine board 1 uses the image data Dp (face of a player) extracted from the image pick-up data Dv is used as a part of the image for a game Gy. However, the present invention is not limited thereto. For example, a time that the big hit is generated may be considered to be a time that "when the prescribed conditions are satisfied", and the face of the player may appear in the animation for presentation. In addition, the game machine according to the present invention is not limited to the pachinko machine board, the slot machine and the pinball machine, and a variety of game machines such as various types of arcade games may be included.

The entire disclosure of Japanese Patent Application Nos. 2002-233883 filed Aug. 9, 2002 and 2003-166841 filed Jun. 11, 2003 are incorporated by reference.

What is claimed is:

1. A game machine comprising:

an image pick-up device for picking-up an image external of the game machine and outputting image pick-up data;

a control part for controlling the image pick-up operation by the image pick-up device and outputting the image pick-up data; and an image display device for displaying a game image for a game;

wherein the image display device includes a projection mechanism for projecting and displaying the game image on a display part of the game machine from a rear surface side of the display part and the image pick-up device is disposed rearward of the display part to pick-up the image external of the game machine through the display part.

2. A game machine according to claim 1, wherein the control part displays the game image based at least in part on image data extracted from the image pick-up data when prescribed conditions are satisfied.

3. A game machine according to claim 1, further comprising an image pick-up data storing part for storing the image pick-up data.

4. A monitor system comprising:

a plurality of game machines as defined in claim 1;

a monitoring display device capable of displaying a monitoring image, and a controller for controlling the monitoring image to be displayed on the monitoring display device based on each image pick-up data outputted by each game machine.

5. A monitor system according to claim 4, wherein the controller controls the monitoring image based on the image pick-up data outputted by the game machines to switch and display images external of the game machines on the monitoring display device in a prescribed sequence.

6. A monitoring system according to claim 4, wherein the controller has an operating part for selecting a game machine from the game machines and controls the monitoring image based on the image pick-up data outputted by the game selected machine.

7. A monitoring system according to claim 4, including an image pick-up data storage device connected to the controller to store the image pick-up data respectively outputted from the game machines.

* * * * *